US008292372B2

(12) United States Patent
Hall et al.

(10) Patent No.: US 8,292,372 B2
(45) Date of Patent: Oct. 23, 2012

(54) RETENTION FOR HOLDER SHANK

(76) Inventors: David R. Hall, Provo, UT (US); Jeff Jepson, Spanish Fork, UT (US); Tyson J. Wilde, Spanish Fork, UT (US)

( * ) Notice: Subject to any disclaimer, the term of this patent is extended or adjusted under 35 U.S.C. 154(b) by 0 days.

(21) Appl. No.: 11/962,497

(22) Filed: Dec. 21, 2007

(65) Prior Publication Data

US 2009/0160238 A1 Jun. 25, 2009

(51) Int. Cl.
*E21C 35/19* (2006.01)

(52) U.S. Cl. ..... 299/104; 299/102

(58) Field of Classification Search ..... 299/102–107, 299/110–111; D15/21, 139
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,121,202 | A | 6/1938 | Killgore |
| 2,124,438 | A | 7/1938 | Struk et al. |
| 2,169,223 | A | 8/1939 | Christian |
| 2,218,130 | A | 10/1940 | Court |
| 2,255,650 | A | 9/1941 | Burke |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,720,392 | A | 10/1955 | Cartlidge |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 2,989,295 | A | 6/1961 | Prox, Jr. |
| 3,135,341 | A | 6/1964 | Ritter |
| 3,254,392 | A | 6/1966 | Novkov |
| 3,294,186 | A | 12/1966 | Buell |

(Continued)

FOREIGN PATENT DOCUMENTS

DE 3307910 A1 * 9/1984

(Continued)

*Primary Examiner* — Sunil Singh
(74) *Attorney, Agent, or Firm* — Philip W. Townsend, III

(57) ABSTRACT

In one aspect of the present invention, a degradation assembly has a holder comprising a first end and a second end and a shank with a longitudinal central bore having an opening at an end proximate the second end. The shank portion of the holder has an inside diameter of the bore and an outside diameter wherein either the inner diameter or the outer diameter comprise at least one recess disposed therein which comprises a depth of less than the distance between the inner diameter and the outer diameters.

13 Claims, 8 Drawing Sheets

U.S. PATENT DOCUMENTS

| | | | | | |
|---|---|---|---|---|---|
| 3,301,339 | A | | 1/1967 | Pennebaker, Jr. | |
| 3,336,081 | A | | 8/1967 | Griffin | |
| 3,342,531 | A | | 9/1967 | Krekeler | |
| 3,342,532 | A | | 9/1967 | Krekeler | |
| 3,379,264 | A | | 4/1968 | Cox | |
| 3,397,012 | A | | 8/1968 | Krekeler | |
| 3,397,013 | A | | 8/1968 | Krekeler | |
| 3,429,390 | A | | 2/1969 | Bennett | |
| 3,429,617 | A | | 2/1969 | Lauber | |
| 3,468,553 | A | | 9/1969 | Ashby et al. | |
| 3,493,165 | A | | 2/1970 | Schonfeld | |
| 3,498,677 | A | * | 3/1970 | Morrow | 299/102 |
| 3,512,838 | A | | 5/1970 | Kniff | |
| 3,583,504 | A | | 6/1971 | Aalund | |
| 3,627,381 | A | | 12/1971 | Krekeler | |
| 3,650,565 | A | | 3/1972 | Kniff | |
| 3,655,244 | A | | 4/1972 | Swisher | |
| 3,746,396 | A | | 7/1973 | Radd | |
| 3,751,115 | A | | 8/1973 | Proctor | |
| 3,764,493 | A | | 10/1973 | Rosar et al. | |
| 3,767,266 | A | | 10/1973 | Krekeler | |
| 3,778,112 | A | | 12/1973 | Krekeler | |
| 3,801,158 | A | | 4/1974 | Radd et al. | |
| 3,807,804 | A | | 4/1974 | Kniff | |
| 3,820,848 | A | | 6/1974 | Kniff | |
| 3,821,993 | A | | 7/1974 | Kniff | |
| 3,830,321 | A | | 8/1974 | McKenry | |
| 3,833,265 | A | * | 9/1974 | Elders | 299/104 |
| 3,865,437 | A | * | 2/1975 | Crosby | 299/107 |
| 3,932,952 | A | | 1/1976 | Helton et al. | |
| 3,942,838 | A | | 3/1976 | Bailey et al. | |
| 3,945,681 | A | | 3/1976 | White | |
| 3,957,307 | A | | 5/1976 | Varda | |
| 3,960,223 | A | | 6/1976 | Kleine | |
| 4,005,914 | A | | 2/1977 | Newman | |
| 4,006,936 | A | | 2/1977 | Crabiel | |
| 4,081,042 | A | | 3/1978 | Johnson et al. | |
| 4,084,856 | A | * | 4/1978 | Emmerich et al. | 299/104 |
| 4,098,362 | A | | 7/1978 | Bonnice | |
| 4,106,577 | A | | 8/1978 | Summers | |
| 4,109,737 | A | | 8/1978 | Bovenkerk | |
| 4,149,753 | A | | 4/1979 | Stoltz | |
| 4,156,329 | A | | 5/1979 | Daniels et al. | |
| 4,199,035 | A | | 4/1980 | Thompson | |
| 4,201,421 | A | | 5/1980 | Den Besten | |
| 4,247,150 | A | | 1/1981 | Wrulich et al. | |
| 4,251,109 | A | | 2/1981 | Roepke | |
| 4,277,106 | A | | 7/1981 | Sahley | |
| 4,289,211 | A | | 9/1981 | Lumen | |
| 4,307,786 | A | | 12/1981 | Evans | |
| 4,337,980 | A | * | 7/1982 | Krekeler | 299/102 |
| 4,397,362 | A | | 8/1983 | Dice et al. | |
| 4,416,339 | A | | 11/1983 | Baker et al. | |
| 4,439,250 | A | | 3/1984 | Acharya et al. | |
| 4,448,269 | A | | 5/1984 | Ishikawa et al. | |
| 4,453,775 | A | * | 6/1984 | Clemmow | 299/81.1 |
| 4,465,221 | A | | 8/1984 | Schmidt | |
| 4,484,644 | A | | 11/1984 | Cook | |
| 4,489,986 | A | | 12/1984 | Dziak | |
| 4,497,520 | A | | 2/1985 | Ojanen | |
| 4,531,592 | A | | 7/1985 | Hayatdavoudi | |
| 4,537,448 | A | | 8/1985 | Ketterer | |
| 4,542,942 | A | | 9/1985 | Zitz et al. | |
| 4,566,545 | A | | 1/1986 | Story et al. | |
| 4,579,491 | A | | 4/1986 | Kull | |
| 4,583,786 | A | | 4/1986 | Thorpe et al. | |
| 4,627,665 | A | | 12/1986 | Ewing et al. | |
| 4,647,111 | A | | 3/1987 | Bronder et al. | |
| 4,669,786 | A | | 6/1987 | Morgan et al. | |
| 4,678,237 | A | | 7/1987 | Collin | |
| 4,682,987 | A | | 7/1987 | Brady | |
| 4,688,856 | A | | 8/1987 | Elfgen | |
| 4,694,918 | A | | 9/1987 | Hall | |
| 4,702,525 | A | | 10/1987 | Sollami et al. | |
| 4,725,098 | A | | 2/1988 | Beach | |
| 4,729,441 | A | | 3/1988 | Peetz et al. | |
| 4,729,603 | A | | 3/1988 | Elfgen | |
| 4,736,533 | A | | 4/1988 | May et al. | |
| 4,746,379 | A | | 5/1988 | Rabinkin | |
| 4,765,419 | A | | 8/1988 | Scholz et al. | |
| 4,765,686 | A | | 8/1988 | Adams | |
| 4,765,687 | A | | 8/1988 | Parrott | |
| 4,776,862 | A | | 10/1988 | Wiand | |
| 4,804,231 | A | | 2/1989 | Buljan et al. | |
| 4,811,801 | A | | 3/1989 | Salesky et al. | |
| 4,880,154 | A | | 11/1989 | Tank | |
| 4,893,875 | A | | 1/1990 | Lonn et al. | |
| 4,907,665 | A | | 3/1990 | Kar et al. | |
| D308,683 | S | | 6/1990 | Meyers | |
| 4,932,723 | A | | 6/1990 | Mills | |
| 4,940,288 | A | | 7/1990 | Stiffler | |
| 4,944,559 | A | | 7/1990 | Sionnet | |
| 4,951,762 | A | | 8/1990 | Lundell | |
| 4,956,238 | A | | 9/1990 | Griffin | |
| 4,962,822 | A | | 10/1990 | Pascale | |
| 4,981,184 | A | | 1/1991 | Knowlton et al. | |
| 5,009,273 | A | | 4/1991 | Grabinski | |
| 5,011,515 | A | | 4/1991 | Frushour | |
| 5,018,793 | A | | 5/1991 | Den Besten | |
| 5,038,873 | A | | 8/1991 | Jurgens | |
| 5,088,797 | A | * | 2/1992 | O'Neill | 299/104 |
| 5,106,166 | A | * | 4/1992 | O'Neill | 299/104 |
| 5,112,165 | A | | 5/1992 | Hedlund et al. | |
| 5,119,714 | A | | 6/1992 | Scott et al. | |
| 5,141,063 | A | | 8/1992 | Quesenbury | |
| 5,141,289 | A | | 8/1992 | Stiffler | |
| 5,154,245 | A | | 10/1992 | Waldenstrom | |
| 5,186,892 | A | | 2/1993 | Pope | |
| 5,201,569 | A | * | 4/1993 | Jurgen | 299/105 |
| 5,251,964 | A | | 10/1993 | Ojanen | |
| 5,261,499 | A | | 11/1993 | Grubb | |
| D342,268 | S | * | 12/1993 | Meyer | D15/139 |
| 5,311,654 | A | * | 5/1994 | Cook | 29/447 |
| 5,332,051 | A | | 7/1994 | Knowlton | |
| 5,332,348 | A | | 7/1994 | Lemelson | |
| 5,361,859 | A | | 11/1994 | Tibbitts | |
| 5,374,111 | A | | 12/1994 | Den Besten et al. | |
| 5,415,462 | A | | 5/1995 | Massa | |
| 5,417,292 | A | | 5/1995 | Polakoff | |
| 5,417,475 | A | | 5/1995 | Graham et al. | |
| 5,447,208 | A | | 9/1995 | Lund | |
| 5,507,357 | A | | 4/1996 | Hult et al. | |
| 5,535,839 | A | | 7/1996 | Brady | |
| 5,542,993 | A | | 8/1996 | Rabinkin | |
| 5,560,440 | A | | 10/1996 | Tibbitts | |
| 5,568,838 | A | | 10/1996 | Struthers et al. | |
| 5,653,300 | A | | 8/1997 | Lund | |
| 5,662,720 | A | | 9/1997 | O'Tigheamaigh | |
| 5,678,644 | A | | 10/1997 | Fielder | |
| 5,732,784 | A | | 3/1998 | Nelson | |
| 5,738,698 | A | | 4/1998 | Kapoor et al. | |
| 5,823,632 | A | | 10/1998 | Burkett | |
| 5,837,071 | A | | 11/1998 | Andersson et al. | |
| 5,842,747 | A | | 12/1998 | Winchester | |
| 5,845,547 | A | | 12/1998 | Sollami | |
| 5,848,657 | A | | 12/1998 | Flood et al. | |
| 5,871,060 | A | | 2/1999 | Jensen et al. | |
| 5,875,862 | A | | 3/1999 | Jurewicz | |
| 5,890,552 | A | | 4/1999 | Scott et al. | |
| 5,896,938 | A | | 4/1999 | Moeny et al. | |
| 5,934,542 | A | | 8/1999 | Nakamura | |
| 5,935,718 | A | | 8/1999 | Demo | |
| 5,944,129 | A | | 8/1999 | Jensen | |
| 5,967,250 | A | | 10/1999 | Lund | |
| 5,992,405 | A | | 11/1999 | Sollami | |
| 6,000,483 | A | | 12/1999 | Jurewicz et al. | |
| 6,006,846 | A | | 12/1999 | Tibbitts | |
| 6,019,434 | A | | 2/2000 | Emmerich | |
| 6,044,920 | A | | 4/2000 | Massa | |
| 6,051,079 | A | | 4/2000 | Andersson et al. | |
| 6,056,911 | A | | 5/2000 | Griffin | |
| 6,059,373 | A | | 5/2000 | Wright et al. | |
| 6,065,552 | A | | 5/2000 | Scott et al. | |
| 6,102,486 | A | | 8/2000 | Briese | |
| 6,113,195 | A | | 9/2000 | Mercier | |
| 6,170,917 | B1 | | 1/2001 | Heinrich | |
| 6,176,552 | B1 | | 1/2001 | Topka et al. | |

| | | | |
|---|---|---|---|
| 6,193,770 | B1 | 2/2001 | Sung |
| 6,196,340 | B1 | 3/2001 | Jensen et al. |
| 6,196,636 | B1 | 3/2001 | Mills |
| 6,196,910 | B1 | 3/2001 | Johnson |
| 6,199,645 | B1 | 3/2001 | Anderson et al. |
| 6,199,956 | B1 | 3/2001 | Kammerer |
| 6,202,761 | B1 | 3/2001 | Forney |
| 6,216,805 | B1 | 4/2001 | Lays |
| 6,270,165 | B1 | 8/2001 | Peay |
| 6,331,035 | B1 | 12/2001 | Montgomery, Jr. |
| 6,332,503 | B1 | 12/2001 | Pessier et al. |
| 6,341,823 | B1 | 1/2002 | Sollami |
| 6,354,771 | B1 | 3/2002 | Bauschulte |
| 6,357,832 | B1 | 3/2002 | Sollami |
| 6,364,420 | B1 | 4/2002 | Sollami |
| 6,371,567 | B1 | 4/2002 | Sollami |
| 6,375,272 | B1 | 4/2002 | Ojanen |
| 6,397,652 | B1 | 6/2002 | Sollami |
| 6,408,959 | B2 | 6/2002 | Bertagnolli et al. |
| 6,412,163 | B1 | 7/2002 | Russell |
| 6,419,278 | B1 | 7/2002 | Cunningham |
| 6,439,326 | B1 | 8/2002 | Huang et al. |
| 6,460,637 | B1 | 10/2002 | Siracki et al. |
| 6,478,383 | B1 | 11/2002 | Ojanen |
| 6,481,803 | B2 | 11/2002 | Ritchey |
| 6,484,826 | B1 | 11/2002 | Anderson et al. |
| 6,499,547 | B2 | 12/2002 | Scott |
| 6,508,516 | B1 | 1/2003 | Kammerer |
| 6,517,902 | B2 | 2/2003 | Drake |
| 6,533,050 | B2 | 3/2003 | Molloy |
| 6,585,326 | B2 | 7/2003 | Sollami |
| 6,601,454 | B1 | 8/2003 | Botnan |
| 6,601,662 | B2 | 8/2003 | Matthias et al. |
| 6,644,755 | B1 | 11/2003 | Kammerer |
| 6,651,758 | B2 | 11/2003 | Xiang et al. |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay |
| 6,719,074 | B2 | 4/2004 | Tsuda |
| 6,732,817 | B2 | 5/2004 | Dewey et al. |
| 6,732,914 | B2 | 5/2004 | Cadden et al. |
| 6,733,087 | B2 | 5/2004 | Hall |
| 6,739,327 | B2 | 5/2004 | Sollami |
| 6,749,033 | B2 | 6/2004 | Griffin et al. |
| 6,758,530 | B2 | 7/2004 | Sollami |
| 6,786,557 | B2 | 9/2004 | Montgomery, Jr. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,863,352 | B2 | 3/2005 | Sollami |
| 6,889,890 | B2 | 5/2005 | Yamazaki |
| 6,929,076 | B2 | 8/2005 | Fanuel et al. |
| 6,938,961 | B2 | 9/2005 | Broom |
| 6,953,096 | B2 | 10/2005 | Gledhill et al. |
| 6,962,395 | B2 | 11/2005 | Mouthaan |
| 6,966,611 | B1 | 11/2005 | Sollami |
| 6,994,404 | B1 | 2/2006 | Sollami |
| 7,097,258 | B2 | 8/2006 | Sollami |
| 7,118,181 | B2 | 10/2006 | Frear |
| 7,204,560 | B2 | 4/2007 | Mercier |
| 7,234,782 | B2 | 6/2007 | Stehney |
| D560,699 | S * | 1/2008 | Omi ..... D15/139 |
| 7,320,505 | B1 | 1/2008 | Hall et al. |
| 7,343,947 | B1 | 3/2008 | Sollami |
| 7,369,743 | B2 | 5/2008 | Watkins et al. |
| 7,377,341 | B2 | 5/2008 | Middlemiss et al. |
| 7,387,345 | B2 | 6/2008 | Hall et al. |
| 7,390,066 | B2 | 6/2008 | Hall et al. |
| 7,413,258 | B2 | 8/2008 | Hall et al. |
| 7,669,938 | B2 | 3/2010 | Hall et al. |
| 7,992,944 | B2 | 8/2011 | Hall et al. |
| 2001/0004946 | A1 | 6/2001 | Jensen |
| 2002/0070602 | A1 | 6/2002 | Sollami |
| 2002/0074851 | A1 | 6/2002 | Montgomery, Jr. |
| 2002/0153175 | A1 | 10/2002 | Ojanen |
| 2002/0175555 | A1 | 11/2002 | Mercier |
| 2003/0015907 | A1 * | 1/2003 | Sollami ..... 299/104 |
| 2003/0047985 | A1 | 3/2003 | Stiffler |
| 2003/0052530 | A1 | 3/2003 | Sollami |
| 2003/0110667 | A1 | 6/2003 | Adachi |
| 2003/0137185 | A1 | 7/2003 | Sollami |
| 2003/0140360 | A1 | 7/2003 | Mansuy et al. |
| 2003/0141350 | A1 | 7/2003 | Noro et al. |
| 2003/0141753 | A1 | 7/2003 | Peay et al. |
| 2003/0209366 | A1 * | 11/2003 | McAlvain ..... 175/427 |
| 2003/0213354 | A1 | 11/2003 | Frers |
| 2003/0230926 | A1 | 12/2003 | Mondy et al. |
| 2003/0234280 | A1 | 12/2003 | Cadden et al. |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2005/0035649 | A1 | 2/2005 | Mercier |
| 2005/0044987 | A1 | 3/2005 | Takayama et al. |
| 2005/0159840 | A1 | 7/2005 | Lin et al. |
| 2005/0173966 | A1 | 8/2005 | Mouthaan |
| 2006/0006727 | A1 | 1/2006 | Frear |
| 2006/0086537 | A1 | 4/2006 | Dennis |
| 2006/0086540 | A1 | 4/2006 | Griffin |
| 2006/0125306 | A1 | 6/2006 | Sollami |
| 2006/0186724 | A1 * | 8/2006 | Stehney ..... 299/104 |
| 2006/0237236 | A1 | 10/2006 | Sreshta |
| 2006/0261663 | A1 | 11/2006 | Sollami |
| 2007/0013224 | A1 | 1/2007 | Stehney |
| 2008/0030065 | A1 | 2/2008 | Frear |
| 2008/0084106 | A1 | 4/2008 | Marathe et al. |

FOREIGN PATENT DOCUMENTS

| | | | |
|---|---|---|---|
| DE | 3 431 495 | | 3/1986 |
| DE | 3500261 | | 7/1986 |
| DE | 3818213 | | 11/1989 |
| DE | 4039217 | | 6/1992 |
| DE | 19821147 | | 11/1999 |
| DE | 10163717 | | 5/2003 |
| EP | 0295151 | | 12/1988 |
| EP | 0412287 | | 2/1991 |
| EP | 0 899 051 | A1 | 3/1999 |
| EP | 1 574 309 | | 9/2005 |
| GB | 2004315 | | 3/1979 |
| GB | 2037223 | | 11/1979 |
| GB | 2151284 | A * | 7/1985 |
| GB | 2423319 | A * | 8/2006 |
| JP | 5 280 273 | | 10/1993 |
| JP | 5280273 | A | 10/1993 |
| RU | 2 079 651 | | 5/1997 |

* cited by examiner

RETENTION FOR HOLDER SHANK

BACKGROUND OF THE INVENTION

Formation degradation, such as asphalt milling, mining, or excavating, may result in wear on attack tools. Consequently, many efforts have been made to efficiently remove and replace these tools.

U.S. Pat. No. 6,585,326 to Sollami, which is herein incorporated by reference discloses a bit holder with its mating bit block utilizing a slight taper in the bit block bore, and a tapered shank on the bit holder that includes a second larger diameter tapered distal segment that combines with an axially oriented slot through the side wall of the bit holder shank to allow a substantially larger interference fit between the distal tapered shank segment and the bit block bore than previously known. When inserting the bit holder in the bit block bore, the distal first tapered segment resiliently collapses to allow insertion of that segment into the bit block bore. A second shank tapered portion is axially inwardly of the first distal tapered portion. The dual tapered shank allows the insertion of the bit holder in the bit block with an interference fit that provides a secure mounting of the bit holder in the bit block.

U.S. Pat. No. 3,865,437 to Crosby, which is herein incorporated by reference discloses a mining tool of the type in which a pick style bit is rotatably mounted in a bore in a support member and is retained therein by retaining means integrally formed on the bit. The retaining means advantageously takes the form of at least one radial projection on the rear end of the bit shank with the bit shank being slotted to impart radial resilience thereto so the bit can be assembled with the support member and readily disassembled therefrom while being retained therein during work operations. The support member may comprise a support block adapted for being fixed to a driver with a sleeve rotatable in a bore in the block and, in turn, rotatably receiving the bit. The sleeve may be slotted axially from the rear end so as to have lateral resilience; and the sleeve may be formed with one or more radial projections or protrusions at the rear end so that the sleeve, also, is releasably retained in the block by retaining means integral therewith.

BRIEF SUMMARY OF THE INVENTION

In one aspect of the present invention, a degradation assembly has a holder comprising a first end and a second end and a shank with a longitudinal central bore having an opening at an end proximate the second end. The shank portion of the holder has a bore with an inside surface and an outside surface having at least one recess disposed therein.

The at least one recess may extend along at least a portion of the shank of the holder. The at least one recess may comprise various geometries: hemispherical, rectangular, triangular, round, or combinations thereof. The inside and outside diameters may comprise a plurality of recesses. In some embodiments, the plurality of recesses disposed in the inside and outside surfaces may be offset from each other. A distance between the recesses may comprise a length of 5% to 50% the circumference of their respective surfaces. The recesses of the inner surface may have a distance between recesses less than a distance between recesses of the outer surface. The at least one recess may have a depth of 5% to 50% the distance from the inner surface to the outer surface and may comprise a width of 5% to 20% the circumference of its respective surface. In some embodiments, the inner or outer surface of the shank may comprise a taper.

In another aspect of the present invention, a degradation assembly has a holder fitted within a block attached to a driving mechanism, the holder having a longitudinal central bore having an opening at an end opposite the driving mechanism. A high impact resistant tool has a carbide bolster axially intermediate a steel shank and an impact tip. The shank portion of the holder has a bore with an inside surface and an outside surface having at least one recess disposed therein.

The shank of the holder may be press-fit into a bore of the block. The press-fit may have a 0.01 to 0.10 inch interference fit between the shank of the holder and the bore of the block. The impact tip may comprise a superhard material bonded to a cemented metal carbide substrate at a non-planar interface. The superhard material may comprise a substantially pointed geometry with an apex comprising a 0.050 to 0.200 inch radius, and a 0.100 to 0.500 inch thickness from an apex to the non-planar interface.

DETAILED DESCRIPTION OF THE INVENTION AND THE PREFERRED EMBODIMENT

Figure 1:
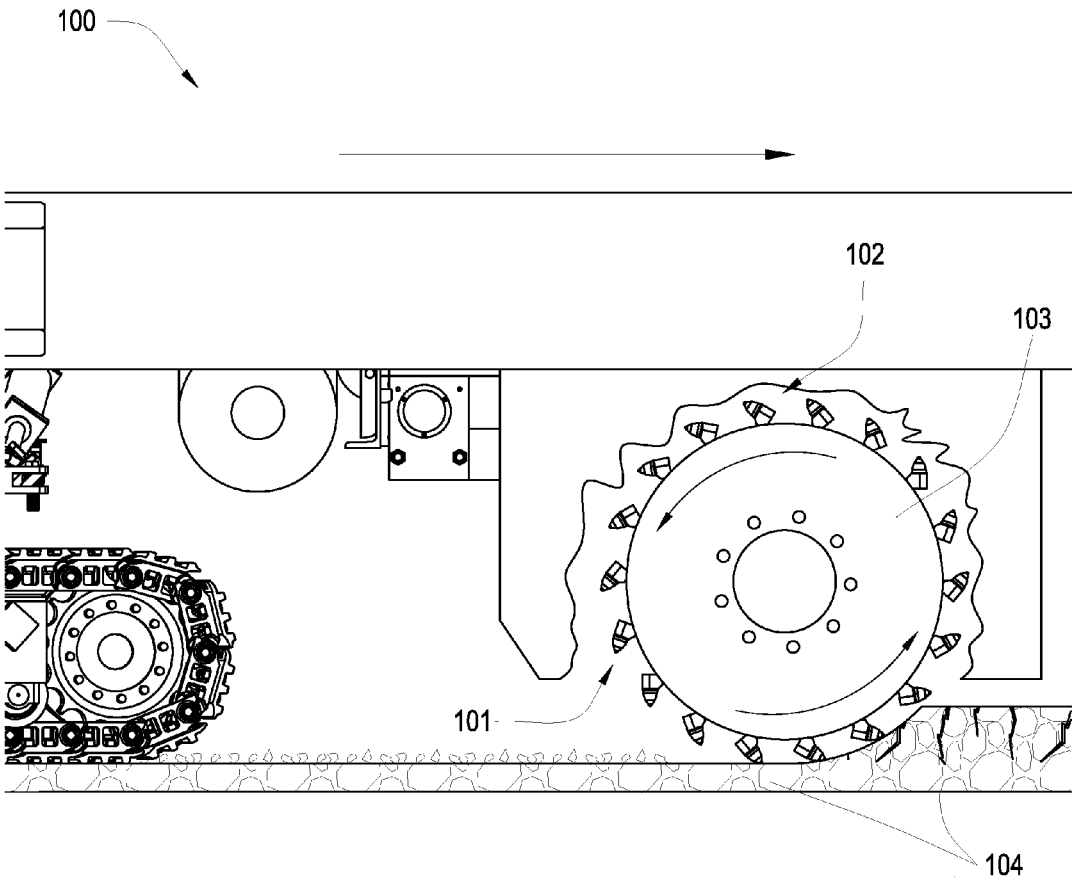
FIG. 1 is a cross-sectional diagram of an embodiment of a plurality of tools on a rotating drum attached to a motor vehicle.

FIG. 1 is a cross-sectional diagram of an embodiment of a plurality of tools 101 attached to a rotating drum 103 connected to the underside of a pavement recycling machine 100. The recycling machine 100 may be a cold planer used to degrade man-made formations 104 such as pavement. Tools 101 may be inserted into a sleeve, the sleeve being fit within a holder 102. The holder 102 may be fit within a block that is attached to the rotating drum 103. The holder 102 may hold the tool 101, at an angle offset from the direction of rotation, such that the tool 101 engages the pavement at a preferential angle. In some embodiments, the tools may be adapted to rotate within the holder.

Figure 2:
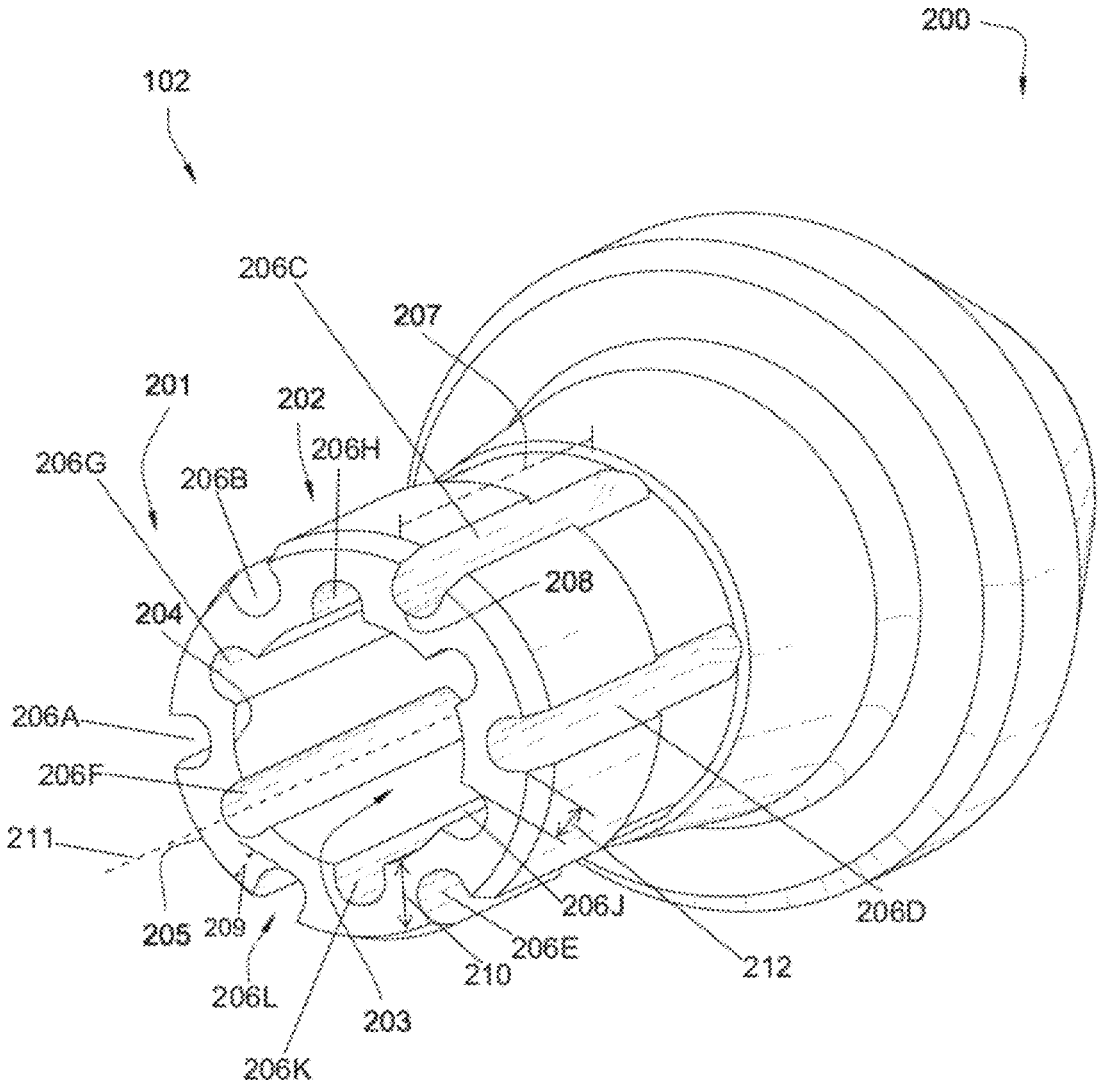
FIG. 2 is a perspective diagram of an embodiment of a tool holder.

Referring now to FIG. 2, the holder 102 has a first end 200 and a second end 201 and a shank 202 with a longitudinal central bore 203. The shank portion 202 of the holder 102 may be press-fit into a block of a driving mechanism. The central bore 203 has an opening proximate the second end 201. The shank portion 202 of the holder 102 has an inner surface 204 of the bore 203 and an outer surface 205. The inner and outer surfaces 204, 205, have at least one recess 206A disposed therein. In the preferred embodiment, the inner surface 204 and the outer surface 205 have a plurality of recesses 206A-L. The plurality of recesses 206A-L may extend along at least a portion of the length 207 of the shank 202. In this embodiment, the recesses 206A-L extend along the entire length 207 of the shank 202. In the preferred embodiment, the recess 206A-L may be hemispherical 208 in section. In the preferred embodiment, the depth 209 of the recesses 206A-L are less than 90 percent of the thickness 210 between the inner surface 204 and the outer surface 205. In some embodiments the depth 209 of the recesses 206A-L are is between 75 and 25 percent of the thickness 210.

The recesses 206A-L may add compliancy to the shank 202 of the holder 102, allowing the holder 102 to be press fit into the block easier than a holder of substantially the same material and diameters but without the recesses. The recesses 206A-L may be disposed generally axially along the shank 202. In some embodiments, the recesses may be disposed spirally or angularly with respect to the central axis 211 of the bore. The recesses may be slots or corrugations with a depth 209 less than the thickness between the inner surface 204 and the outer diameters surface 205. The recesses 206A-L may extend axially along the entire length of the shank or less. In some embodiments, the recesses extend less than 75 percent of the length of the length like length 207 of the shank. The recesses 206F-K of the inner surface 204 and the recesses 206A-E and 206 L of the outer surface 205 may be offset from each other such that there is a distance 212 between the recesses of equal to or greater than the depths 209 of the recesses 206A-L.

In some embodiments of the present invention, the recesses, such as recesses 206A-L, are machined or forged into the shank, such as shank 202. In other embodiments, the shank is cast and the recesses are formed during a casting process. The casting process may incorporate molds and/or dies.

Figure 3:
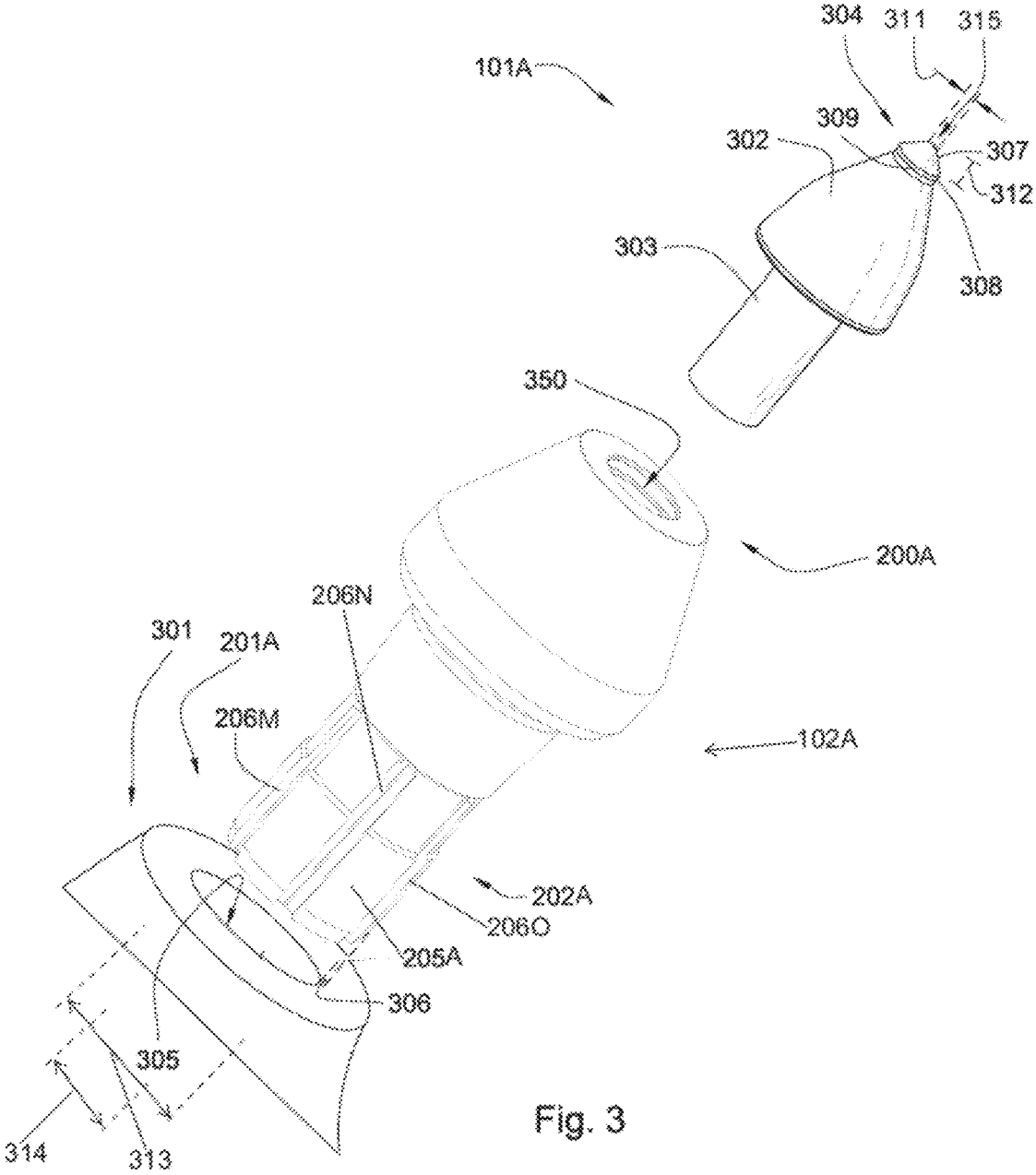
FIG. 3 is an exploded diagram of an embodiment of a degradation assembly.

FIG. 3 discloses an exploded diagram of an embodiment of a high impact resistant tool 101A, a holder 102A, and a sleeve 301. The holder 102A may be fitted within the sleeve 301 attached to a driving mechanism. The holder 102A has a longitudinal central bore 350 at a first end 200A opposite the driving mechanism. The central bore 350 is adapted to receive a steel shank 303 of the tool 101A. The tool 101A has a carbide bolster 302 axially intermediate the steel shank 303 and an impact tip 304. The impact tip 304 may comprise a superhard material 307 bonded to a cemented metal carbide substrate 308 at a non-planar interface 309. The superhard material 307 may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The superhard material 307 may have a substantially pointed geometry with an apex 315 comprising a 0.050 to 0.200 inch radius 311, and a 0.100 to 0.500 inch thickness 312 from the apex 308 to the non-planar interface 309.

The shank portion 202A of the holder 102A has a longitudinal central bore 203A having an opening proximate the second end 201A of the shank 202A. The outer surface 205A of the shank 202A may have a plurality of recesses like recesses 206M-O disposed therein. In this embodiment, the shank 202A of the holder 102A may be tapered and may be press-fit into a bore 305 of the block 301. The shank 202A may have a diameter 313 greater than a diameter 314 of the bore 305 disposed in the block 301. The press-fit may comprise an interference fit 306 of 0.01 to 0.10 inch between the shank 202A of the holder 102A and the bore 305 of the block 301. The plurality of recesses like recesses 206F-K (FIG. 2) disposed within the shank 202A may help in the removal and replacement of the holder 102A. The plurality of recesses like recesses 206M-O formed in the shank 202A may allow for a reliable interference fit 306 such that the holder 102A is held tightly within the block 301 during operation. The recesses 206M-O may also allow for easy and quick removal of the holder 102A from a block.

Figure 4:
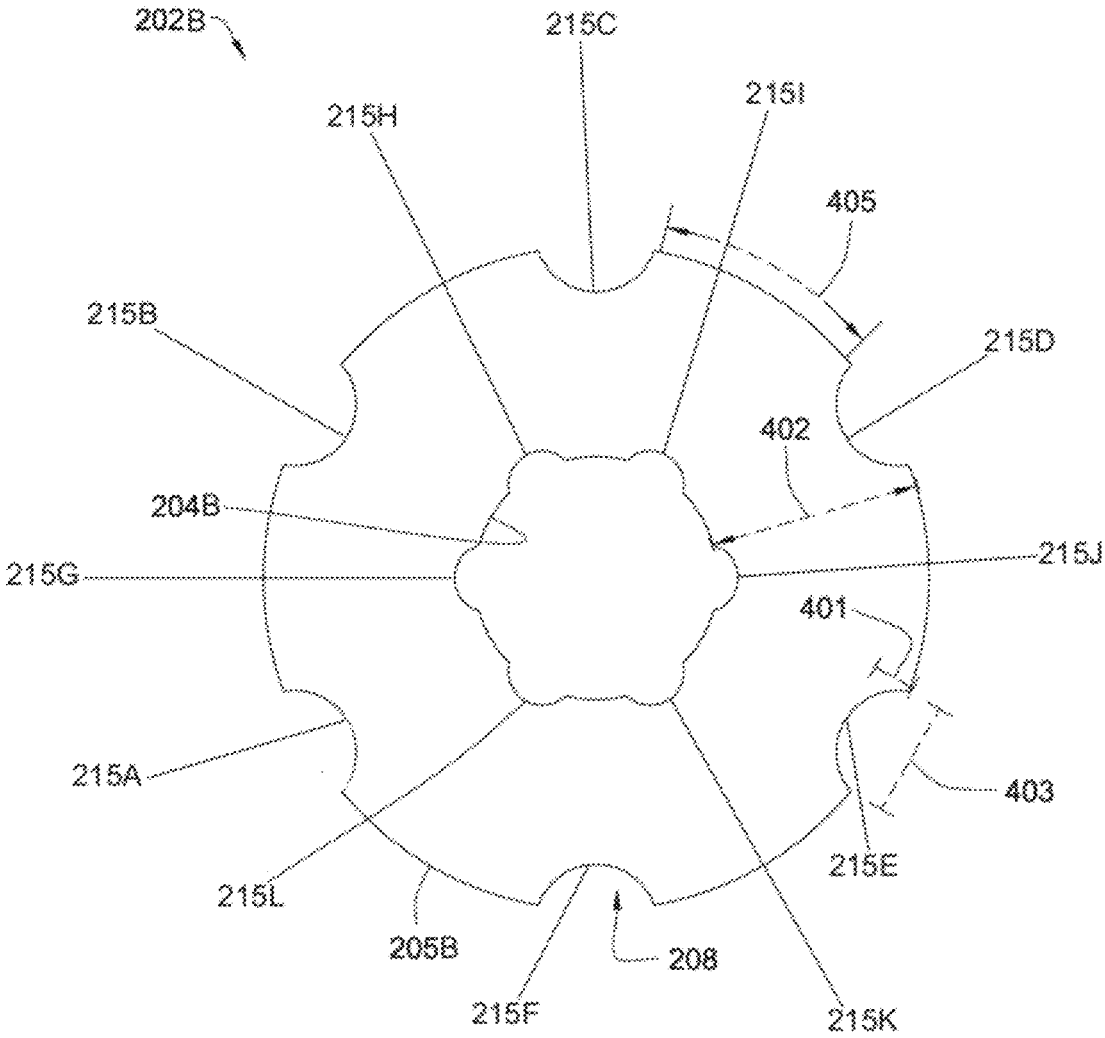
FIG. 4 is a cross-sectional diagram of an embodiment of a shank of a tool holder.

FIGS. 4 through 9 illustrate various geometries of recesses like recesses 215A-L disposed within an inner surface 204B and an outer surface 205B of the shank 202B of the holder, such as holder 102A (FIG. 2). FIG. 4 illustrates a shank 202B having a plurality of recesses 215A L which are hemispherical (semi circular) in section 208. In this embodiment, the plurality of recesses 215A-L of the inner surface 204B and the outer surface 205B alternate such that a recess 215A-F of the outer surface 205B is offset with the recesses 215G-L on the inner surface 204B. The plurality of recesses 206A-L may have a depth 401 of 5 to 50% the distance 402 from the inner surface 204B to the outer surface 205B. The recesses 215A-L may also have a width 403 of 5 to 20% the circumference of the respective inner and outer surfaces 204B, 205B. A distance 405 between the recesses 215A-L may be 10 to 50% of the circumference of the respective inner and outer surfaces 204B, 205B. In this embodiment, the plurality of recesses 215G-L of the inner diameter 204B comprises a distance between recesses less than a distance between recesses 215A-L of the outer diameter 205B.

Figure 5:
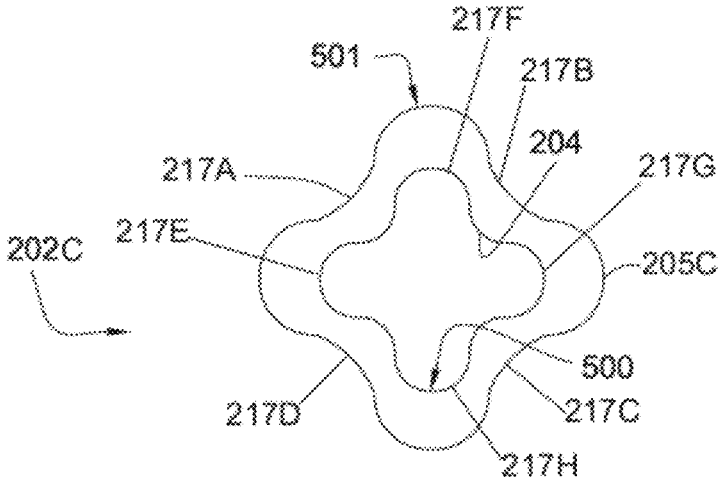
FIG. 5 is a cross-sectional diagram of another embodiment of a shank of a tool holder.

FIG. 5 illustrates a shank 202C having a plurality of recesses 217A-H with a rounded geometry 500. The shank 202C may be press-fit into a bore disposed within a block. The press-fit may be between the bore of the block and outer edges 501 of an outer surface 205C of the shank 202C.

Figure 6:
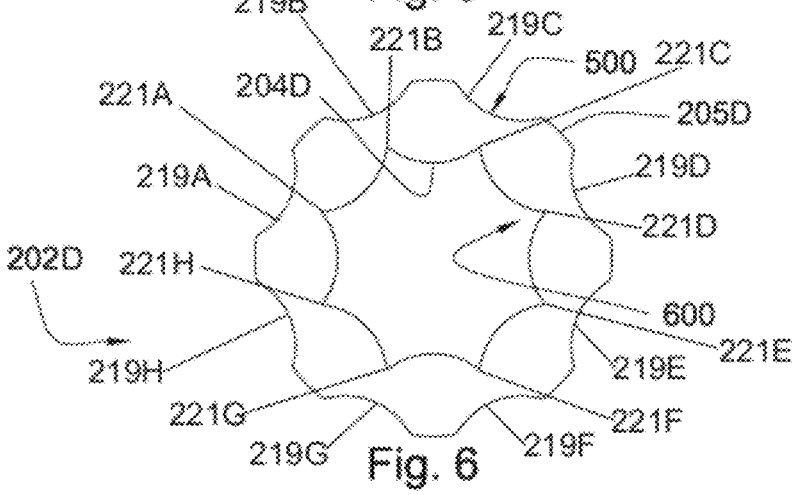
FIG. 6 is a cross-sectional diagram of another embodiment of a shank of a tool holder.

Referring now to FIG. 6, shank 202D has a plurality of recesses 221A-H formed in an inner surface 204D of a shank 202D. The recesses 221A-H may be triangular in section 600 while the plurality of recesses 219A-H formed in an outer surface 205D may be rounded 500 in section. In this embodiment, the plurality of recesses 221A-H of the inner surface 204D align with recesses 219A-H of the outer surface 205D.

Figure 7:
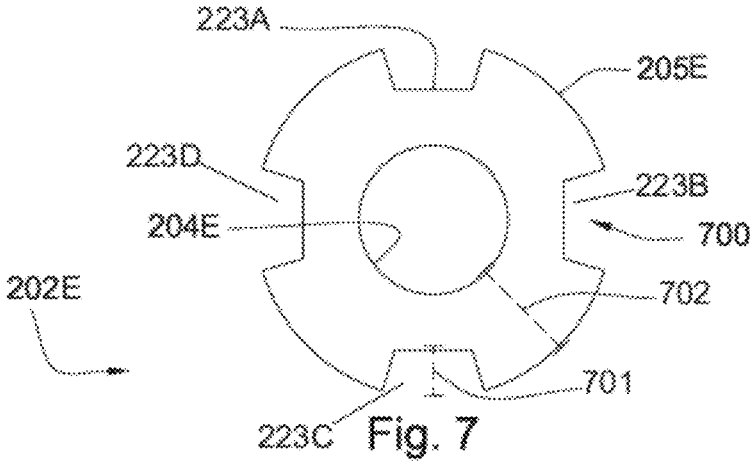
FIG. 7 is a cross-sectional diagram of another embodiment of a shank of a tool holder.

FIG. 7 discloses a shank 202E having a plurality of recesses 223A-D formed in an outer surface 205E of a shank 202E. In this embodiment, the recesses 223A-D formed in the outer surface 205E may have a depth 701 greater than 50% of the distance 702 between an inner surface 204E and the outer surface 205E. The plurality of recesses 223A-D may also be rectangular in section 700.

Figure 8:
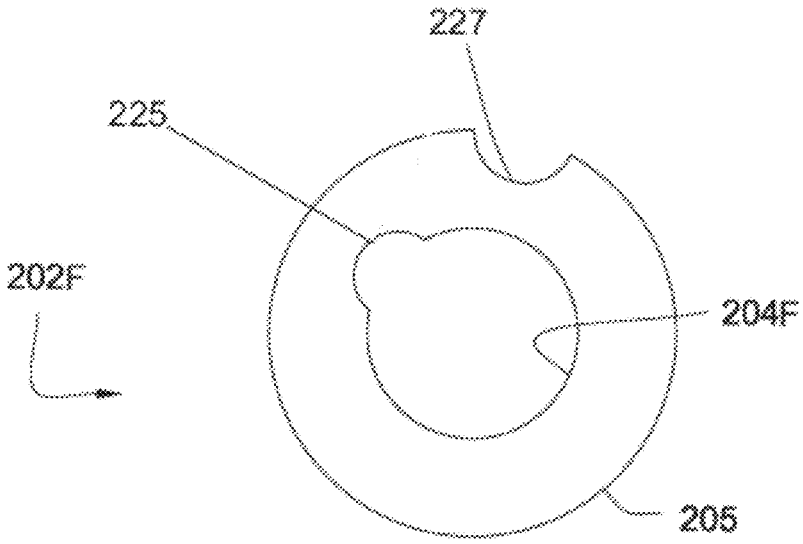
FIG. 8 is a cross-sectional diagram of another embodiment of a shank of a tool holder.

FIG. 8 shows an embodiment of a shank 202F having at least one recess 225 within an inner surface 204F and at least one recess 227 disposed within an outer surface 205F.

Figure 9:
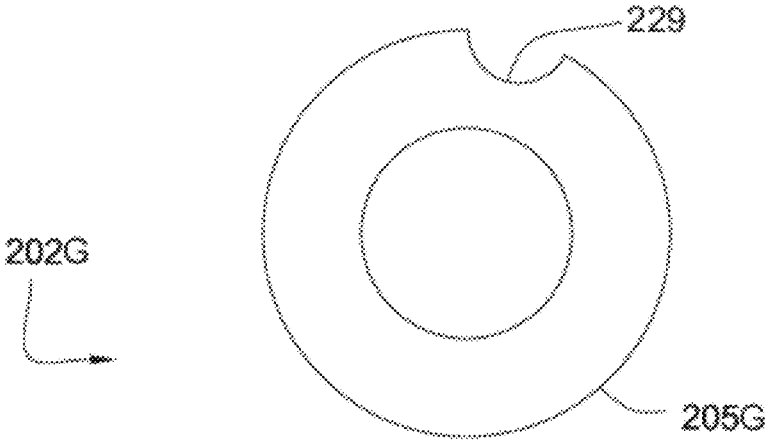
FIG. 9 is a cross-sectional diagram of another embodiment of a shank of a tool holder.

FIG. 9 illustrates an embodiment of a shank 202G having at least one recess 229 formed in an outer surface 205G.

Figure 10:
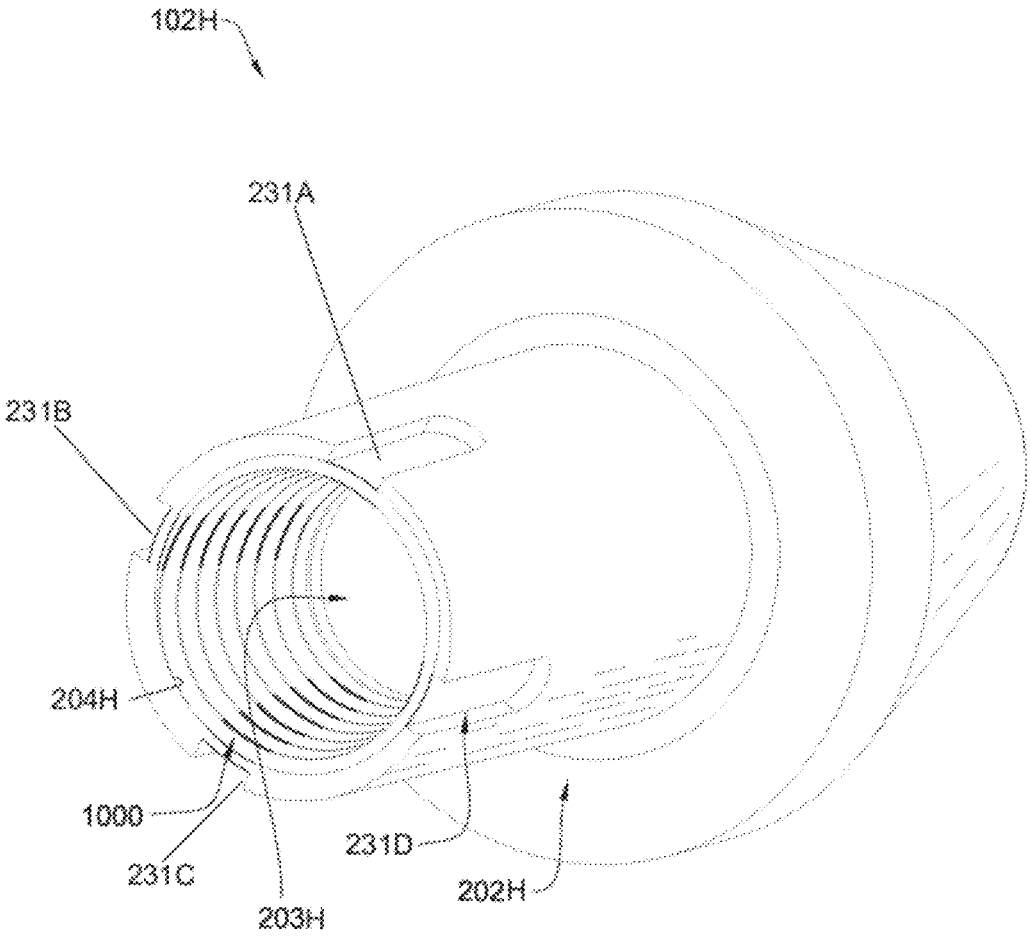
FIG. 10 is a perspective diagram of another embodiment of a tool holder.

FIG. 10 discloses a perspective view of an embodiment of a holder 102H comprising a set of threads 1000 formed in an inner surface 204H of a shank 202H. In this embodiment, a central bore 203H of the holder 102H may be adapted to receive an attachment mechanism. The attachment mechanism may be a spacer which is adapted to radially expand a portion of the shank 202H proximate the plurality of recesses 231A-D.

Figure 11:
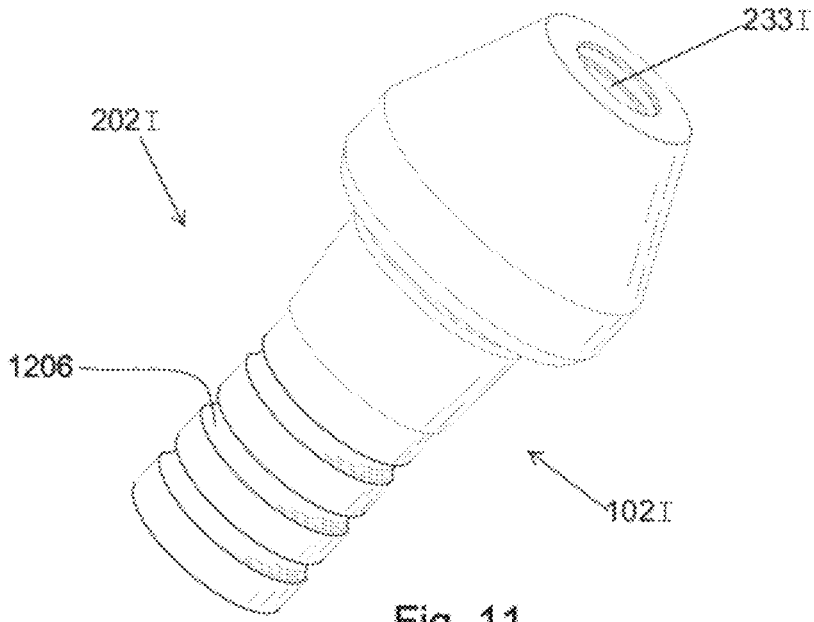
FIG. 11 is a perspective diagram of another embodiment of a tool holder.

FIG. 11 discloses holder 102I with a shank 202I having an annular recess 1206 substantially normal to a central axis 233 of the holder 102J.

Figure 12:
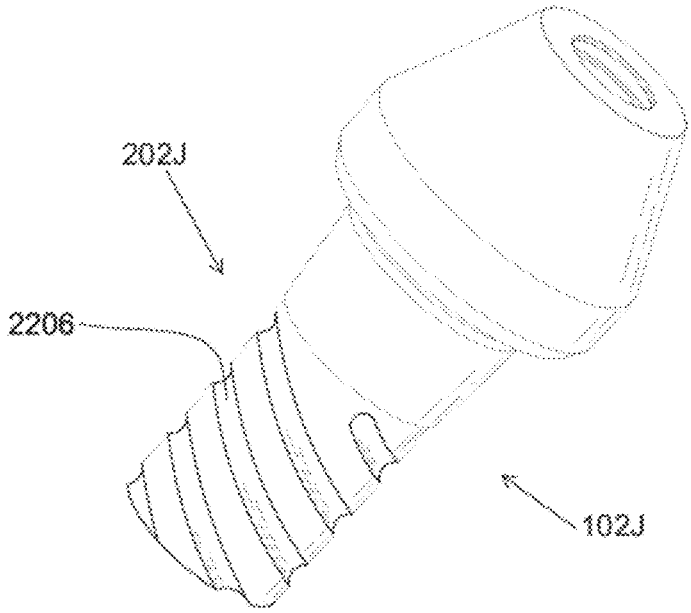
FIG. 12 is a perspective diagram of another embodiment of a tool holder.

FIG. 12 discloses a holder 102J with a shank 202J having a recess 2206 which forms a spiral along the length of the holder 102J.

Whereas the present invention has been described in particular relation to the drawings attached hereto, it should be understood that other and further modifications apart from those shown or suggested herein, may be made within the scope and spirit of the present invention.

What is claimed is:

1. A holder for coupling a tool to an aperture in a block, the holder comprising:

a shank having a first end and a second end, said first end being configured for connecting with a degradation tool, said shank having an outer surface;

a bore formed in said shank and extending from said second end toward said first end, said bore having an inner surface spaced from said outer surface;

a shank wall defined by said inner surface and said outer surface, said wall having a wall thickness; and a first recess formed in said inner surface and a second recess formed in said outer surface, said first recess having a first depth between five percent and ninety percent of said wall thickness, said second recess having a second depth between five and ninety percent of said wall thickness, said first recess and said second recess being proximate said second end and extending along a length of said shank, wherein said recesses provide compliancy to the shank of the holder allowing the shank of the holder to be press fit into the aperture of the block.

2. The holder of claim 1, wherein said inner surface and said outer surface each have a plurality of recesses.

3. The holder of claim 2, wherein each recess of said plurality of recesses formed in said inner surface are radially offset from each recess of said plurality of recesses formed in said outer surface.

4. The holder of claim 3, wherein said inner surface has an inner circumference, and wherein adjacent recesses of said plurality of recesses formed in said inner surface are spaced apart a distance which is from about 5 percent to about 50 percent of the circumference of said inner surface.

5. The holder of claim 4, wherein said outer surface has an outer circumference, and wherein adjacent recesses of said plurality of recesses formed in said outer surface are spaced apart a distance which is from about 5 percent to about 50 percent of the circumference of said outer surface.

6. The holder of claim 1, wherein said first recess has a depth between from about 5 percent to about 50 percent of said wall thickness.

7. The holder of claim 1, wherein said inner surface has an inner circumference and said outer surface has an outer circumference and wherein said first recess is formed to have a width from about 5 percent to about 20 percent of the circumference of the surface in which it is formed.

8. The holder of claim 1, wherein said shank has a first diameter toward said first end and a second diameter proximate said second end, said second diameter being less than said first diameter and wherein said shank tapers from said first diameter to said second diameter.

9. The holder of claim 1, wherein said holder is a casting including the first recess and the second recess.

10. The holder of claim 1, wherein said outer surface has a first diameter and said aperture has a second diameter, wherein said first diameter is 0.01 inch to 0.10 inch greater than said second diameter.

11. A holder for coupling a tool to an aperture in a block, said holder comprising:

a first end being sized and shaped to retain a tool;

a second end spaced apart from said first end, the second end having an outer surface;

a bore formed in said second end and extending toward said first end, said bore having an inner surface spaced from said outer surface;

a wall defined by said inner surface and said outer surface, said wall having a wall thickness; and a first recess formed in said outer surface, said first recess being proximate said second end and extending a length of said holder, said first recess having a first depth between five percent and ninety percent of said wall thickness; and a second recess formed in said inner surface, said second recess having a second depth less than said wall thickness, wherein said recesses provide compliancy to the second end of the holder allowing the second end of the holder to be press fit into the aperture of the block.

12. The holder of claim 11, wherein said second end of said holder is cylindrical.

13. The holder of claim 11, wherein said first end is frustroconical in shape.

* * * * *